US005171374A

United States Patent [19]

Kim et al.

[11] Patent Number: 5,171,374

[45] Date of Patent: Dec. 15, 1992

[54] RAPIDLY SOLIDIFIED SUPERPLASTIC ALUMINUM-LITHIUM ALLOYS AND PROCESS FOR MAKING SAME

[75] Inventors: Nack J. Kim, Florham Park, N.J.; Eui W. Lee, Warminster, Pa.

[73] Assignee: Allied-Signal Inc., Morris Township, Morris County, N.J.

[21] Appl. No.: 276,748

[22] Filed: Nov. 28, 1988

[51] Int. Cl.[5] ..... C22F 1/04

[52] U.S. Cl. ..... 148/698; 148/415; 148/416; 148/417; 148/418; 148/699; 148/700; 148/702; 420/902

[58] Field of Search ..... 148/11.5 A, 12.7 A, 148/11.5 P, 415–418, 438–440; 420/902

[56] References Cited

U.S. PATENT DOCUMENTS 4,661,172 4/1987 Skinner et al. ..... 148/12.7 A

*Primary Examiner*—R. Dean

*Attorney, Agent, or Firm*—Ernest D. Buff; Gerhard H. Fuchs

[57] ABSTRACT

A rapidly solidified aluminum base lithium containing alloy is subjected to at least one overaging treatment and a plurality of rolling passes. Upon completion of the process, the alloy is comprised of grains having an ultra-fine grain size. A predominant number of the grains have grain boundaries pinned by the precipitation of $Al_3Zr$ phase. The alloy has an elongation greater than 500% at temperature above about 500° C. and a strain rate above about $4\times10^{-2}$/s.

5 Claims, 6 Drawing Sheets

RAPIDLY SOLIDIFIED SUPERPLASTIC ALUMINUM-LITHIUM ALLOYS AND PROCESS FOR MAKING SAME

DESCRIPTION

1. Field of the Invention

The invention relates to rapidly solidified aluminum-lithium alloys, and, in particular, to a process for developing superplasticity therein.

2. Background of the Invention

Superplastic forming of sheet products is becoming an increasingly important method of producing complex shapes in aluminum alloys. Superplastic forming offers the aerospace industry considerable potential not only for reducing weight and manufacturing costs, but also for the development of novel designs of aircraft structure. Superplastic forming also increases the yield rate of materials, which influence the total cost of an aircraft. Additional weight savings offered by the new generation of aluminum-lithium alloys has generated further interest.

A general characteristic of current ingot cast Al-Li alloys is the need for plastic deformation after solution treatment and before aging in order to develop high strength. This requirement places restrictions on the production sequences that can be used for superplastic forming of sheet metal parts. For example, a typical sequence in which forming is done in the annealed condition, with subsequent solution treatment and aging, would result in final strength significantly less than that of a T8 temper, which may not be acceptable for many demanding applications. On the other hand, rapidly solidified aluminum-lithium alloys do not require any mechanical working between solution treatment and aging to obtain adequate strength and ductility, which is ideal for superplastically formed parts. Several attempts have been made, using the thermomechanical treatment developed for ingot cast alloys, to impart superplasticity to rapidly solidified aluminum-lithium alloys. None of these attempts, however, have been able to provide superplasticity to rapidly solidified aluminum-lithium alloys, indicating that the thermomechanical treatment developed for the ingot cast alloys cannot be utilized for rapidly solidified alloys. The need exists at present for a thermomechanical treatment that is capable of making rapidly solidified aluminum-lithium alloys superplastic.

SUMMARY OF THE INVENTION

The present invention provides a process for developing superplasticity in rapidly solidified aluminum-lithium alloys. Alloys produced in accordance with the process of the invention exhibit elongation greater than 500 percent at temperature above about 520° C. and a strain rate above about $4\times10^{-2}$/s. The aluminum-lithium alloys produced in accordance with the process of the invention consist essentially of the formula $Al_{bal.}Li_aZr_bX_c$, wherein X is at least one element selected from the group consisting of Cu, Mg, Si, Sc, Ti, U, Hf, Cr, V, Mn, Fe, Co and Ni, "a" ranges from about 2.5–5wt %, "b" ranges from 0.15–2 wt %, "c" ranges from about 0–5wt % and the balance is aluminum. The microstructure of these alloys when processed in accordance with the invention is comprised of grains having an ultrafine grain size, a predominant number of the grains having grain boundaries pinned by the precipitation of $Al_3Zr$ phase. This microstructure is developed by subjecting an alloy having the formula delineated above to at least one overaging treatment followed by a plurality of warm rolling passes. A novel process for making superplastic rapidly solidified aluminum-lithium alloy is thereby provided wherein the rapidly -solidified aluminum-lithium alloy has an improved superplasticity.

The superplastic rapidly solidified aluminum-lithium alloy produced in accordance with the present invention has an ultrafine grain size which, advantageously, offers the superplasticity at very high strain rate. As a consequence, the superplastic alloys of the invention are especially suited for use in aerospace components having complicated shapes such as seat pans, engine intakes and under carriage covers and the like.

BRIEF DESCRIPTION OF THE DRAWINGS

The invention will be more fully understood and further advantages will become apparent when reference is made to the following detailed description and the accompanying drawings, in which.

Figure 3:
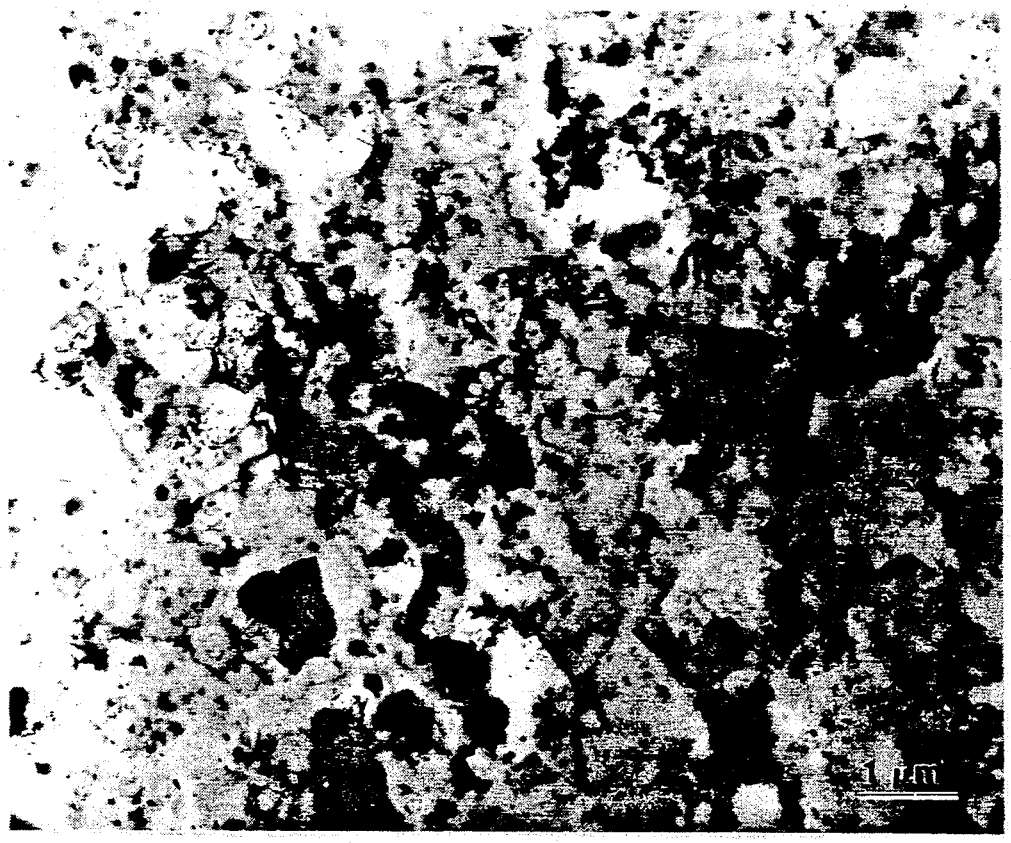
Figure 4:
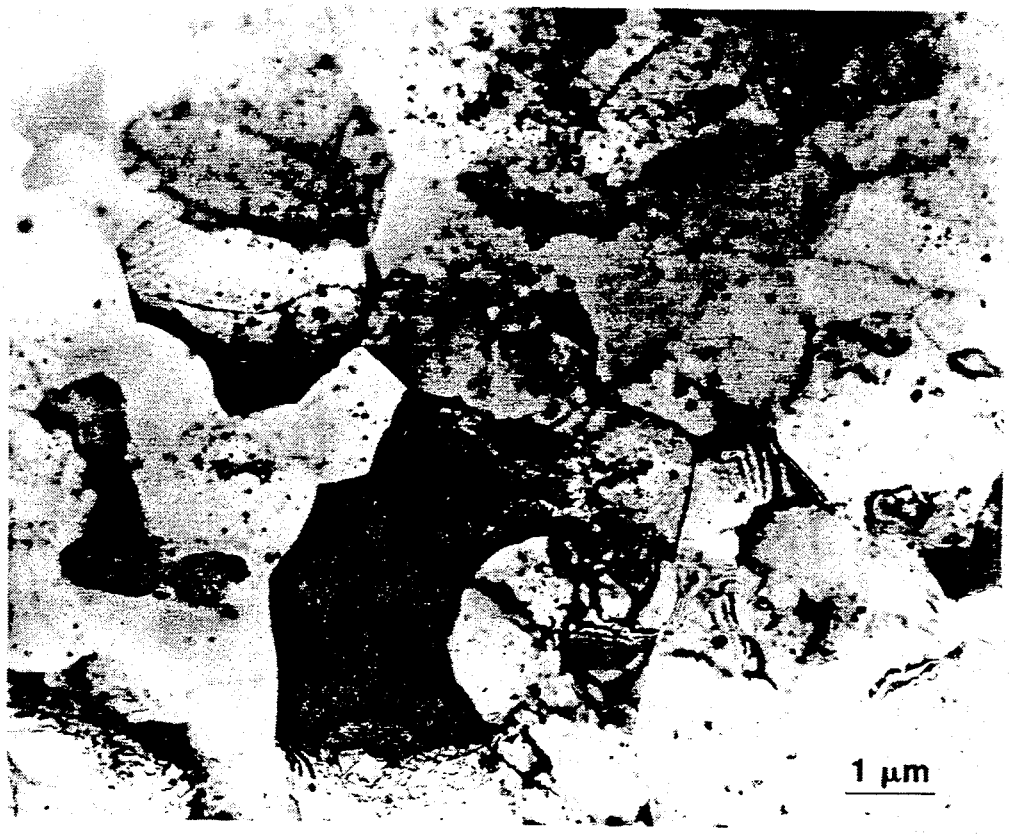
Figure 5:
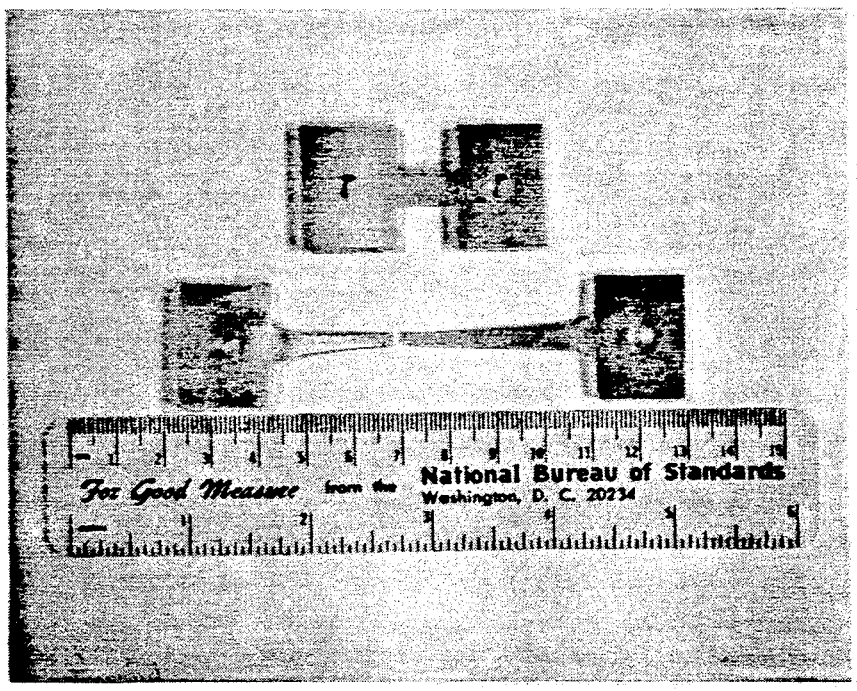
Figure 6:
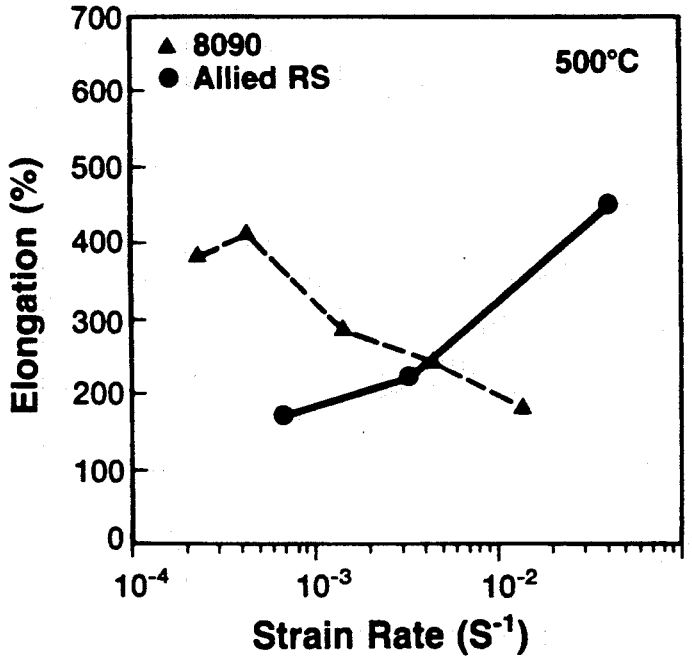

solidified alloy having the composition Al-3Li-5Mg-0.5Zr in as-extruded condition, showing the coarse oxide phase along the prior powder particle boundaries, which are undesirable for superplastic forming;

FIG. 3 is the transmission electron micrograph of a rapidly solidified alloy having the composition of Al-3Li-1Cu-0.5Mg-0.5Zr, the alloy having been subjected to thermomechanical treatment (overaging at 350° C. for 5 hours followed by rolling at 310° C. with total amount of deformation 75%) followed by exposure at 520° C., showing the occurrence of dynamic recrystallization resulting in a formation of fine grains;

FIG. 4 shows the transmission electron micrograph of a rapidly solidified alloy having a composition of Al-3Li-1Cu-0.5Mg-0.5Zr after tensile testing at 520° C., showing the ability of a rapidly solidified alloy to maintain fine grain size after high temperature exposure;

FIG. 5 shows the tensile samples of a rapidly solidified alloy having a composition of Al-3Li-1Cu-0.5Mg-C.5Zr before and after testing at 520° C.;

FIG. 6 shows the effect of strain rate on superplastic elongation of ingot cast aluminum-lithium 8090 alloy and rapidly solidified Al-3Li-1Cu-0.5Mg-0.5Zr alloy.

DESCRIPTION OF THE PREFERRED EMBODIMENTS

Generally stated, the present invention provides a process for making superplastic rapidly solidified aluminum-lithium alloys. The process involves the use of at least one overaging treatment followed by a plurality of rolling passes conducted during processing of the alloy. When processed in accordance with the invention, the alloy has a unique microstructure consisting essentially of grains having an ultrafine (<1 μm ) grain size, a predominant number of the grains having boundaries pinned by $Al_3Zr$ phase (FIG. 1) due to the thermomechanical treatment, as hereinafter described. Alloys may also contain other Li, Cu and/or Mg containing precipitates provided such precipitates do not significantly deteriorate the superplastic formability of the alloy.

Figure 2:
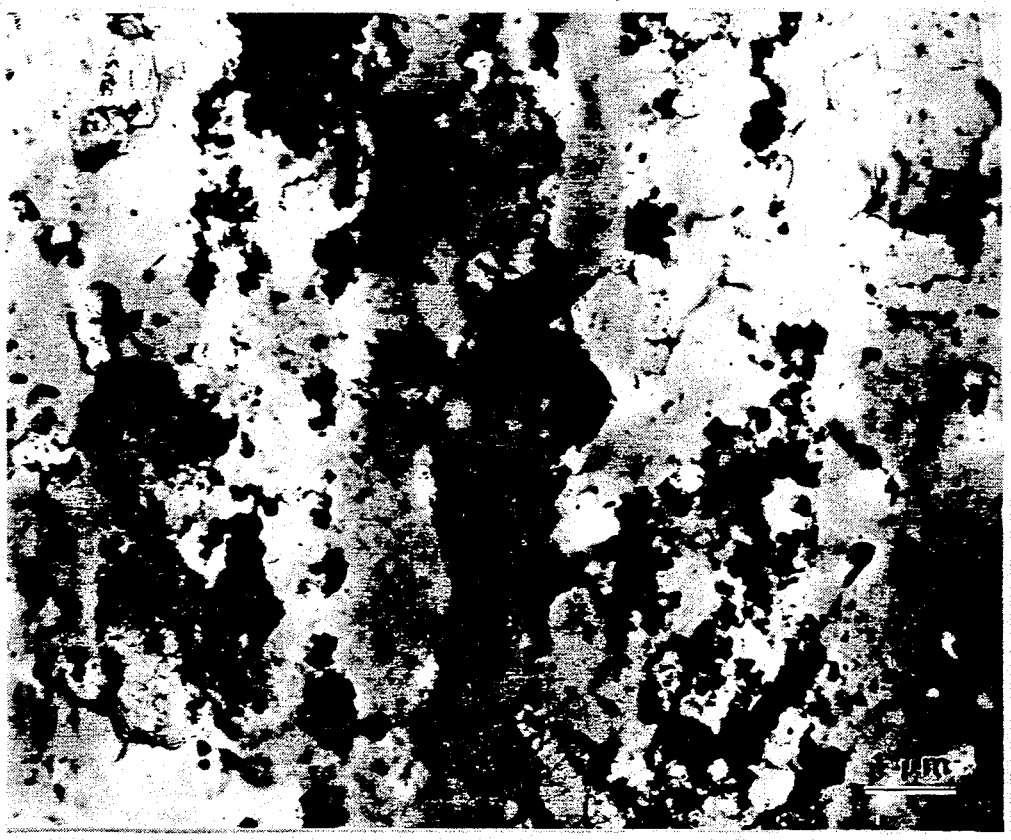

The factors governing the superplastic formability of the rapidly solidified aluminum-lithium alloys are primarily their grain size and oxide phase distribution along the prior powder particle boundaries. The microstructure is determined largely by the composition, casing conditions and the final thermomechanical treatments such as extrusion, rolling and/or heat treatment parameters. Normally, an alloy in the as-processed condition (extruded) has coarse oxide phase along the prior powder particle boundaries, which are not desirable for superplasticity (FIG. 2). Further processing is required to develop microstructural features appropriate for certain characteristic properties.

Figure 1:
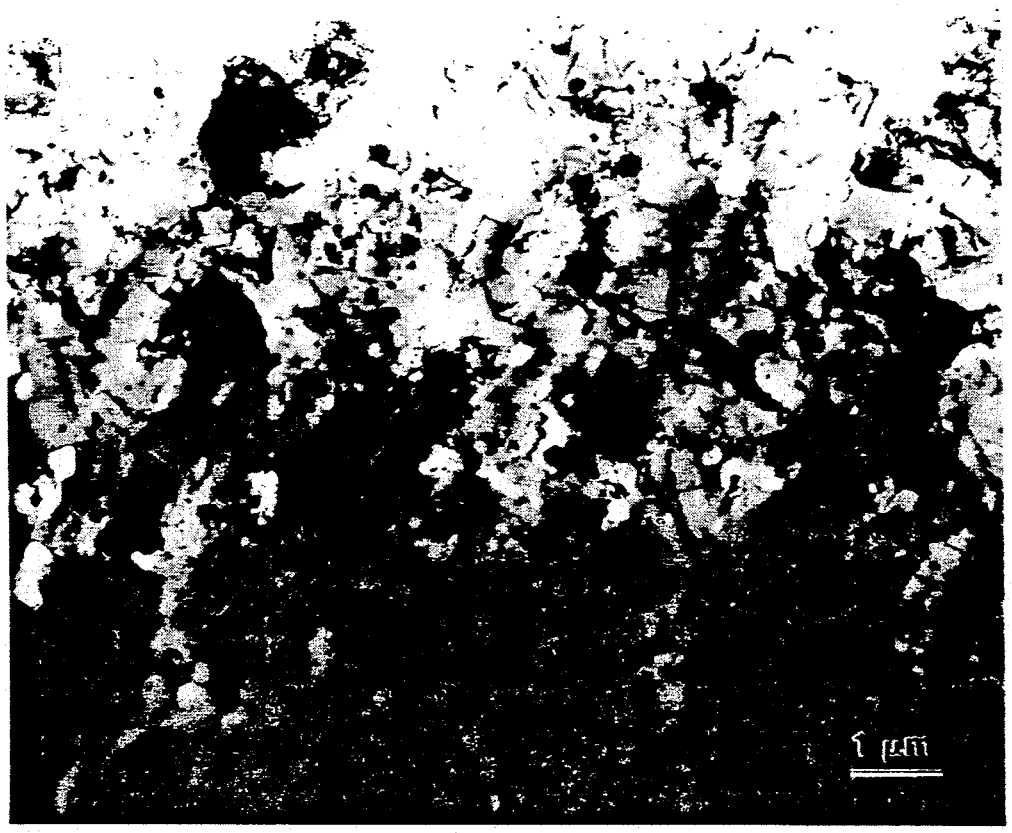
FIG. 1 is a transmission electron micrograph of a rapidly solidified alloy having the composition Al-3Li-1Cu-0.5Mg-0.5Zr, the alloy having been subjected to thermomechanical treatment (overaging at 350° C. for 5 hours followed by rolling at 310° C. with total amount of deformation 75%) to develop ultrafine (<1 μm ) grain size whose grain boundaries are pinned by $Al_3Zr$ phase.

The alloy is given an initial overaging treatment, that is, heating at a temperature ($T_1$) for a period of time sufficient to substantially soften the alloy, but not to promote the formation of coarse phases which adversely affect the formability of the alloy, followed by cooling to ambient temperature. Generally, the time at temperature $T_1$, will be dependent on the composition of the alloy and will typically range from about 2 to 10 hours. The alloy is then reheated to a rolling temperature, $T_2$, and then rolled to a 10% reduction in thickness. The temperature of the alloy after the first rolling is then maintained by putting the alloy in a furnace, the temperature of which is the same as the rolling temperature. The alloy is then rolled again to a 10% reduction in thickness. The above heating, rolling and reheating steps are repeated until final reduction in thickness is greater than about 75% thereafter the alloy is subjected to an air cooling to ambient temperature. At this point, the alloy by a unique microstructure which consists essentially of grains having an ultrafine grain size, the boundaries of a predominant number of the grains being pinned by $Al_3Zr$ phase (FIG. 1). This unique microstructure is responsible for the improved superplasticity of the rapidly solidified aluminum-lithium alloys. During exposure at high temperatures, there is a dynamic recrystallization resulting in a formation of ultrafine grains whose grain boundaries are pinned by $Al_3Zr$ phase (FIG. 3). These ultrafine grains show a very slow coarsening behavior during deformation at high temperature due to the presence of $Al_3Zr$ phase at grain boundaries The final grain size after superplastic deformation typically is about 2 μm (FIG. 4), which is quite similar to the grain size for the original extrusion. The result is that, upon being processed in accordance with the invention, rapidly solidified aluminum-lithium alloys exhibit elongation greater than 500 at % high temperature and at high strain rate (see FIG. 5). Typically, maximum superplasticity for rapidly solidified aluminum-lithium alloys are exhibited at a strain rate of $4\times10^{-2}$/s, which is two orders of magnitude higher than conventional aluminum alloys and one order of magnitude higher than ingot cast aluminum-lithium alloys. The ability of rapidly solidified aluminum-lithium alloys to exhibit superplasticity at such a high strain rate is quite advantageous for the practical application of these alloys.

The exact temperature, $T_1$, to which the alloy is heated in the overaging treatment is not critical as long as there is a softening of the alloy and no precipitation of deleterious coarse second phase particles in the microstructure. The optimum temperature range for $T_1$, is from about 300° C. to 350° C. The exact temperature, $T_2$, whose range is from 300° C. to 400° C. depends on the alloying elements present. Generally, the times at temperature $T_2$ are different depending upon the composition of the alloy, the processing history, and the size of the rolled plate and/or sheet, and will typically range from 0.1 to 10 hours.

EXAMPLE 1

An alloy having a composition of Al-3Li-1Cu-0.5Mg-0.5Zr was solutionized at 550° C. for 2 hours, quenched into water at about 20° C., overaged at 350° C. for 5 hours, and subjected to 9 pass rolling at 310° C. with total reduction of 75%. Reheating time during each pass of rolling was maintained for at least 10 minutes. Tensile testing of the alloy was conducted at 500° C. with strain rate ranging from 2×10–4/s to 4×10–2/s FIG. 6 shows the tensile elongations of rapidly solidified alloy as a function of strain rate. For comparison, tensile elongations of ingot cast aluminum-lithium alloy 8090 are also included in FIG. 6. It can be seen from FIG. 6 that maximum elongation for ingot cast alloy is obtained at strain rate of about $4\times10^{-4}$/s, while rapidly solidified alloy shows the maximum elongation at strain rate of $4\times10^{-2}$/s, which is about two orders of magnitude higher than ingot cast alloy.

EXAMPLE 2

This example illustrates the other advantages of the claimed process on the superplastic formability of rapidly solidified aluminum-lithium alloy. An alloy having a composition of Al-3Li-1Cu-0.5Mg-0.5Zr was solutionized at 550° C. for 2 hours, quenched into water at about 20° C., overaged at 350° C. for 5 hours, and subjected to 9 pass rolling at 310° C. with total reduction of 75%. Reheating time during each pass of rolling was maintained for at least 10 minutes. Tensile testing of the ally at 520° C. shows that the total elongation is 530% at 520° C. as compared to 450% at 500° C. The advantages of using higher forming, provided that there is no appreciable precipitation of coarse second phase in the microstructure during cooling. As shown, there is no coarse deleterious second phase present in the microstructure.

Having thus described the invention in rather full detail, it will be understood that such detail need not be strictly adhered to but that further changes may suggest themselves to one having ordinary skill in the art, all falling within the scope of the invention as defined by the subjoined claims.

What is claimed is:

1. A process for developing superplasticity in rapidly solidified aluminum-lithium alloys, comprising the steps of: subjecting a rapidly solidified aluminum-lithium alloy, to thermomechanical treatment comprised of at least one overaging treatment followed by a plurality of warm rolling passes, the alloy being rolled to about 10% reduction in thickness by each of the rolling passes and the rolling passes being continued until the total amount of reduction in thickness of said alloy is greater than 75%, said alloy consisting essentially of the formula $Al_{bal}Li_aZr_bX_c$, wherein X is at least one element selected from the group consisting of Cu, Mg, Si, Sc, Ti, U, Hf, Cr, V, Mn, Fe, Co and Ni, "a" ranges from about 2.5–5 wt %, "b" ranges from 0.15–2wt %, "c" ranges from about 0–5wt % and the balance is aluminum.

2. A process as recited by claim 1, wherein said alloy, upon completion of said process, is comprised of grains having an ultrafine grain size, a predominant number of said grains having grain boundaries pinned by the precipitation of $Al_3Zr$ phase.

3. A process as recited by claim 2, wherein said alloy has an elongation greater than 500% at temperature about 500° C. and a strain rate above about $4\times10^{-2}$/s.

4. A process for making superplastic rapidly solidified aluminum-lithium alloys, comprising the steps of:

a) heating a rapidly solidified aluminum-lithium alloy, consisting essentially of the formula $Al_{bal}Li_aZr_bX_c$, wherein X is at least one element selected from the group consisting of Cu, Mg, Si, Sc, Ti, U, Hf, Cr, V, Mn, Fe, Co and Ni, "a" ranges from about 2.5–5wt %, "b" ranges from 0.15–2wt %, "c" ranges from about 0–5wt % and the balance is aluminum, to a temperature, $T_1$, for a period of time sufficient to substantially soften the alloy;

b) cooling said alloy to ambient temperature;

c) heating said alloy to a rolling temperature, $T_2$, and then rolling the alloy to about a 10% reduction in thickness:

d) reheating said alloy to rolling temperature, $T_2$;

e) repeating steps c and d until the total amount of reduction in thickness of said alloy is greater than 75%: and f) cooling said alloy to ambient temperature.

5. A process as recited by claim 4, wherein $T_1$ ranges from 300° C. to 350° C. and $T_2$ ranges from about 300° C. to 400° C.

* * * * *